US009790579B2

(12) United States Patent
Yuga et al.

(10) Patent No.: US 9,790,579 B2
(45) Date of Patent: Oct. 17, 2017

(54) HIGH TENSILE STRENGTH STEEL PLATE HAVING EXCELLENT WELD HEAT-AFFECTED ZONE LOW-TEMPERATURE TOUGHNESS AND METHOD FOR PRODUCING SAME

(75) Inventors: Masao Yuga, Chita (JP); Shigeki Kitsuya, Kurashiki (JP); Yusuke Terazawa, Fukuyama (JP); Minoru Suwa, New York, NY (US); Kenji Hayashi, Kurashiki (JP)

(73) Assignee: JFE Steel Corporation, Tokyo (JP)

( * ) Notice: Subject to any disclaimer, the term of this patent is extended or adjusted under 35 U.S.C. 154(b) by 430 days.

(21) Appl. No.: 14/377,088

(22) PCT Filed: Mar. 1, 2012

(86) PCT No.: PCT/JP2012/055890

§ 371 (c)(1),
(2), (4) Date: Oct. 23, 2014

(87) PCT Pub. No.: WO2013/118313

PCT Pub. Date: Aug. 15, 2013

(65) Prior Publication Data

US 2015/0075682 A1 Mar. 19, 2015

(30) Foreign Application Priority Data

Feb. 7, 2012 (JP) ..... 2012-023954

(51) Int. Cl.

| | |
|---|---|
| ***C22C 38/02*** | (2006.01) |
| ***C22C 38/04*** | (2006.01) |
| ***C22C 38/14*** | (2006.01) |
| ***C22C 38/12*** | (2006.01) |
| ***C22C 38/06*** | (2006.01) |
| ***C21D 8/02*** | (2006.01) |
| ***C21D 9/46*** | (2006.01) |
| ***C22C 38/58*** | (2006.01) |
| ***C22C 38/00*** | (2006.01) |
| ***C22C 38/08*** | (2006.01) |
| ***C22C 38/16*** | (2006.01) |
| ***C22C 38/18*** | (2006.01) |
| ***C22C 38/40*** | (2006.01) |
| ***C22C 38/42*** | (2006.01) |
| ***C22C 38/48*** | (2006.01) |
| ***C22C 38/50*** | (2006.01) |
| ***C21D 6/00*** | (2006.01) |
| ***C22C 38/46*** | (2006.01) |

(52) U.S. Cl.

CPC ..... *C22C 38/58* (2013.01); *C21D 6/001* (2013.01); *C21D 6/002* (2013.01); *C21D 6/004* (2013.01); *C21D 6/005* (2013.01); *C21D 6/008* (2013.01); *C21D 8/0226* (2013.01); *C21D 8/0263* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/18* (2013.01); *C22C 38/40* (2013.01); *C22C 38/42* (2013.01); *C22C 38/46* (2013.01); *C22C 38/48* (2013.01); *C22C 38/50* (2013.01); *C21D 2211/005* (2013.01)

(58) Field of Classification Search

None

See application file for complete search history.

(56) References Cited

FOREIGN PATENT DOCUMENTS

| | | | |
|---|---|---|---|
| EP | 2272994 | | 1/2011 |
| EP | 2407570 | | 1/2012 |
| JP | S60-184663 | A | 9/1985 |
| JP | H 03-53367 | B2 | 8/1991 |
| JP | H 05-186823 | A | 7/1993 |
| JP | 05195058 | | 8/1993 |
| JP | 2001-335884 | A | 12/2001 |
| JP | 2003-147484 | A | 5/2003 |
| JP | 2005281842 | | 10/2005 |
| JP | 2007-231312 | A | 9/2007 |
| JP | 2009-185343 | A | 8/2009 |
| JP | 2009-221534 | A | 10/2009 |
| JP | 2009-235458 | A | 10/2009 |
| KR | 20100116701 | | 11/2010 |
| WO | 2009072753 | | 6/2009 |
| WO | WO 2009/123292 | A1 | 10/2009 |
| WO | 2011096456 | | 8/2011 |
| WO | 2011099408 | | 8/2011 |

OTHER PUBLICATIONS

International Search Report dated May 15, 2012, application No. PCT/JP2012/055890.

(Continued)

*Primary Examiner* — Deborah Yee

(74) *Attorney, Agent, or Firm* — RatnerPrestia

(57) ABSTRACT

The present invention provides a high tensile strength steel plate having a chemical composition containing, in percent by mass, 0.03% to 0.12% of C, 0.01% to 0.30% of Si, 0.5% to 1.95% of Mn, 0.008% or less of P, 0.005% or less of S, 0.015% to 0.06% of Al, 0.011% to 0.05% of Nb, 0.005% to 0.02% of Ti, 0.001% to 0.006% of N, 0.0005% to 0.003% of Ca, optionally, one or two or more of Cr, Mo, V, Cu, and Ni, in which Ceq is 0.44 or less, Ti/N is 1.5 to 3.5, and parameter formulas composed of specific elements for controlling the sulfide morphology and the degree of center segregation in the steel are satisfied, and the balance being Fe and incidental impurities, in which the hardness of the center segregation area of the steel sheet is further specified.

10 Claims, No Drawings

(56) References Cited

OTHER PUBLICATIONS

European Search Report mailed Jul. 8, 2015 in European Application No. 12868309.1.
Korean Office Action for Korean Application No. 20147022966, dated Apr. 19, 2016, 18 pages.
Chinese Office Action for Chinese Application No. 201280069269.4, dated Jul. 7, 2016, including Concise Statement of Relevance, 17 pages.

HIGH TENSILE STRENGTH STEEL PLATE HAVING EXCELLENT WELD HEAT-AFFECTED ZONE LOW-TEMPERATURE TOUGHNESS AND METHOD FOR PRODUCING SAME

CROSS REFERENCE TO RELATED APPLICATIONS

This is the U.S. National Phase application of PCT/JP2012/055890, filed Mar. 1, 2012, which claims priority to Japanese Patent Application No. 2012-023954, filed Feb. 7, 2012, the disclosures of each of these applications being incorporated herein by reference in their entireties for all purposes.

FIELD OF THE INVENTION

The present invention relates to a high tensile strength steel plate used for steel structures, such as ships, marine structures, pressure vessels, and penstocks, and a method for producing the same, and more particularly, relates to a high tensile strength steel plate with a yield stress (YS) of 400 MPa or more, not only having excellent strength and toughness in the base metal, but also having excellent low-temperature toughness (crack tip opening displacement (CTOD) property) in the low to medium heat input multi-layer weld, and a method for producing the same.

BACKGROUND OF THE INVENTION

Steels used for ships, marine structures, and pressure vessels are subjected to welding and formed into structures with desired shapes. Accordingly, these steels are required not only to have high strength and excellent toughness in base metals from the viewpoint of safety of the structures, but also to have excellent toughness in welded joints (weld metals) and weld heat-affected zones (hereinafter, referred to as "HAZ").

As the basis for evaluation of toughness of steel, the absorbed energy by the Charpy impact test has been mainly used. In recent years, in order to enhance reliability, the crack tip opening displacement test (hereinafter, referred to as the "CTOD test") has been often used. In this test, a specimen having a fatigue precrack in a toughness-evaluating portion is subjected to three-point bending, and the amount of crack tip opening (plastic deformation volume) immediately before failure is measured to evaluate the resistance to occurrence of brittle failure.

In the CTOD test, since a fatigue precrack is used, an extremely small region can be a toughness-evaluating portion. When there is a local embrittlement area, even if good toughness is obtained by the Charpy impact test, low toughness may be shown by the CTOD test in some cases.

Local embrittlement areas are likely to occur in the weld heat-affected zone (hereinafter, also referred to as "HAZ") which is subjected to a complicated thermal history due to multilayer welding in a thick steel plate or the like. The bond (boundary between the weld metal and the base metal) and a region in which the bond is formed into a dual-phase region by reheating (region in which coarse grains are formed in the first cycle of welding and which is heated into a ferrite and austenite dual-phase region by the subsequent welding pass, hereinafter, referred to as the "dual phase re-heating area") correspond to local brittle areas.

Since the bond is subjected to a high temperature just below the melting point, austenite grains are coarsened and are likely to be transformed, by the subsequent cooling, into the upper bainite structure having low toughness. Thus, the matrix in itself has low toughness. Furthermore, in the bond, brittle structures, such as the Widmannstatten structure and island martensite (M-A constituent) (MA), are likely to be formed, and thereby, the toughness is further degraded.

In order to improve the weld heat-affected zone toughness, for example, a technique in which by finely dispersing TiN in a steel, coarsening of austenite grains is suppressed or TiN is used as nuclei for the ferrite transformation has been practically used. However, in the bond, heating may be performed to a temperature range in which TiN is dissolved in some cases, and as the requirements for the weld zone low-temperature toughness become more stringent, the effect described above is less likely to be obtained.

On the other hand, Patent Literatures 1 and 2 each disclose a technique in which, by dispersing fine grains in a steel by means of combined addition of rare-earth elements (REM) and Ti, grain growth of austenite is suppressed, and thereby, the weld zone toughness is improved.

In addition, a technique of dispersing oxides of Ti, a technique of Combining capability of ferrite nucleation of BN with oxide dispersion, and a technique of enhancing toughness by controlling sulfide morphology by means of addition of Ca and REM have also been proposed.

However, these techniques are intended for steels having relatively low strength and low contents of alloy elements. In the case of steels having higher strength and high contents of alloy elements, the HAZ structure is caused not to contain ferrite, and thus the techniques are not applicable.

Accordingly, as a technique that facilitates formation of ferrite in the weld heat-affected zone, Patent Literature 3 discloses a technique in which mainly the amount of Mn added is increased to 2% or more. However, in a continuous cast steel, Mn is likely to be segregated in the central portion of a slab, and the center segregation area ratio increases not only in the base metal but also in the weld heat-affected zone. The center segregation area serves as the origin of the fracture, thus resulting in degradation in toughness of the base metal and HAZ.

On the other hand, in the dual phase re-heating area, carbon is concentrated in the region reverse-transformed into austenite by dual phase re-heating, and the brittle bainite structure including island martensite is formed during cooling, resulting in degradation in toughness. Accordingly, techniques have been disclosed in which, by decreasing the contents of C and Si in a steel composition, formation of island martensite is suppressed and toughness is improved, and by adding Cu, the strength of the base metal is ensured (for example, Patent Literatures 4 and 5). In these techniques, the strength is enhanced by precipitation of Cu by means of aging treatment. However, since a large amount of Cu is added, hot ductility is degraded, and productivity is impaired.

PATENT LITERATURE

[PTL 1] Japanese Examined Patent Application Publication No. 3-053367

[PTL 2] Japanese Unexamined Patent Application Publication No. 60-184663

[PTL 3] Japanese Unexamined Patent Application Publication No. 2003-147484

[PTL 4] Japanese Unexamined Patent Application Publication No. 5-186823

[PTL 5] Japanese Unexamined Patent Application Publication No. 2001-335884

SUMMARY OF THE INVENTION

In recent years, in steel structures, such as ships, marine structures, pressure vessels, and penstocks, as their sizes have increased, there has been a demand to further increase the strength of steels. Steels used for such steel structures are often thick, for example, with a thickness of 35 mm or more. Therefore, in order to ensure a yield strength grade of 400 MPa or more, steel chemical composition systems having increased amounts of alloy elements added are advantageous. However, as described above, improvement of toughness in the bond and the dual phase re-heating area is far from being sufficiently studied for high strength steels having large contents of alloy elements.

Accordingly, the present invention aims to provide a high tensile strength steel plate which has a yield stress (YS) of 400 MPa or more and excellent low-temperature toughness (CTOD property) in the weld heat-affected zone in the low to medium heat input multi-layer weld and which is suitable for use in steel structures, such as ships, marine structures, pressure vessels, and penstocks, and a method for producing the same.

The present inventors have designed a composition specifically on the basis of the following technical thoughts and completed the present invention.

1. Since the CTOD property is evaluated using a specimen of a steel plate with the entire thickness, the center segregation area in which the composition is concentrated serves as the origin of the fracture. Consequently, in order to improve the CTOD property of the weld heat-affected zone, the amounts of elements that are likely to be concentrated as center segregation of the steel plate are controlled to appropriate levels, and thereby, hardening of the center segregation area is suppressed. In the center of the slab, which is the finally solidifying portion when molten steel solidifies, C, Mn, P, Ni, and Nb have a higher level of concentration than other elements. Therefore, by controlling the amounts of these elements added on the basis of the center segregation area hardness index, the hardness in the center segregation is suppressed.

2. In order to improve the weld heat-affected zone toughness, by effectively using TiN, coarsening of austenite grains is suppressed in the vicinity of the weld bond. By controlling Ti/N to an appropriate level, uniform fine dispersion of TiN in the steel can be achieved.

3. Crystallization of the compound of Ca (CaS), which is added for the purpose of sulfide morphology control, is utilized for improving the weld heat-affected zone toughness. Since CaS is crystallized at a low temperature compared with oxides, uniform fine dispersion can be achieved. By controlling the amount of CaS added and the amount of dissolved oxygen in the molten steel at the time of addition to appropriate ranges, solute S is secured even after crystallization of CaS, and therefore, MnS is precipitated on the surface of CaS to form complex sulfides. Since a Mn dilute zone is formed around the MnS, ferrite transformation is further promoted.

That is, the present invention includes the following aspects:

1. A high tensile strength steel plate having excellent weld heat-affected zone low-temperature toughness characterized by having a chemical composition containing, in percent by mass, 0.03% to 0.12% of C, 0.01% to 0.30% of Si, 0.5% to 1.95% of Mn, 0.008% or less of P, 0.005% or less of S, 0.015% to 0.06% of Al, 0.011% to 0.05% of Nb, 0.005% to 0.02% of Ti, 0.001% to 0.006% of N, 0.0005% to 0.003% of Ca, in which Ceq specified by formula (1) below is 0.44 or less, Ti/N is 1.5 to 3.5, and formulas (2) and (3) below are satisfied, and the balance being Fe and incidental impurities, in which the hardness of a center segregation area of the steel plate satisfies formula (4) below:

$$Ceq=[C]+[Mn]/6+([Cu]+[Ni])/15+([Cr]+[Mo]+[V])/5 \quad (1)$$

$$0<\{[Ca]-(0.18+130\times[Ca])\times[O]\}/1.25/[S]<1 \quad (2)$$

$$5.5[C]^{4/3}+15[P]+0.90[Mn]+0.12[Ni]+7.9[Nb]^{1/2}+0.53[Mo]\leq 3.10 \quad (3)$$

where [M] is the content of element M (percent by mass)

$$H_{Vmax}H_{Vave}\leq 1.35+0.006/[C]-t/500 \quad (4)$$

where $H_{Vmax}$ is the maximum value of Vickers hardness of the center segregation area, $H_{Vave}$ is the average value of Vickers hardness of a portion of the steel plate excluding a region extending from the front surface to ¼ of the plate thickness, a region extending from the back surface to ¼ of the plate thickness, and the center segregation area, [C] is the C content (percent by mass), and t is the thickness (mm) of the steel plate.

2. The high tensile strength steel plate having excellent weld heat-affected zone low-temperature toughness according to item 1, characterized in that the steel composition further contains, in percent by mass, one or two or more selected from 0.20% to 2% of Cr, 0.1% to 0.7% of Mo, 0.005% to 0.1% of V, 0.49% or less of Cu, and 2% or less of Ni.

3. A method for producing a high tensile strength steel plate having excellent weld heat-affected zone low-temperature toughness characterized by including heating a steel having the chemical composition according to item 1 or 2 to 1,050° C. to 1,200° C., then subjecting the steel to hot rolling in such a manner that the cumulative rolling reduction in the temperature range of 950° C. or higher is 30% or more, and the cumulative rolling reduction in the temperature range of lower than 950° C. is 30% to 70%, and then performing accelerated cooling to 600° C. or lower at a cooling rate of 1.0° C./s or more.

4. The method for producing a high tensile strength steel plate having excellent weld heat-affected zone low-temperature toughness according to item 3, characterized by further including, after cooling is stopped, performing temper treatment at 450° C. to 650° C.

5. The high tensile strength steel plate having excellent weld heat-affected zone low-temperature toughness according to item 1 or 2, characterized in that the concentrations of the individual elements in the center segregation area satisfy formula (5) below:

$$Rs=12.5(X[Si]+X[Mn]+X[Cu]+X[Ni])+1.5X[P]+1.8X[Nb]<64.3 \quad (5)$$

where X[M] represents the ratio of the concentration of element M in the center segregation area to the average concentration of element M, i.e., (concentration of M in center segregation area)/(average concentration of M), obtained by EPMA line analysis.

6. A method for producing a high tensile strength steel plate having excellent weld heat-affected zone low-temperature toughness characterized by including heating a steel having the chemical composition according to item 5 to 1,050° C. to 1,200° C., then subjecting the steel to hot rolling in such a manner that the cumulative rolling reduction in the temperature range of 950° C. or higher is 30% or more, and the cumulative rolling reduction in the temperature range of lower than 950° C. is 30% to 70%, and then performing accelerated cooling to 600° C. or lower at a cooling rate of 1.0° C./s or more.

7. The method for producing a high tensile strength steel plate having excellent weld heat-affected zone low-temperature toughness according to item 6, characterized by further including, after cooling is stopped, performing temper treatment at 450° C. to 650° C.

According to the present invention, it is possible to obtain a high tensile strength steel plate which has a yield stress (YS) of 400 MPa or more and excellent low-temperature toughness, in particular, an excellent CTOD property, in the low to medium heat input multi-layer weld and which is suitable for use in large steel structures, such as marine structures, and a method for producing the same, which is industrially very useful.

DETAILED DESCRIPTION OF EMBODIMENTS OF THE INVENTION

In the present invention, the chemical composition and the hardness distribution in the thickness direction are specified.

1. Chemical Composition

Reasons for limiting the chemical composition will be described. Note that "%" means "percent by mass" in the description.

C: 0.03% to 0.12%

C is an essential element for securing the strength of the base metal as the high tensile strength steel plate. When the C content is less than 0.03%, hardenability is degraded, and it becomes necessary to add a large amount of a hardenability-improving element, such as Cu, Ni, Cr, or Mo, in order to secure strength, resulting in a rise in costs and degradation in weldability. Furthermore, when the amount of C added exceeds 0.12%, weldability is markedly degraded, and also the toughness of the weld zone is degraded. Therefore, the C content is set in the range of 0.03% to 0.12%, and preferably 0.05% to 0.10%.

Si: 0.01% to 0.30%

Si is added as a deoxidizing element and in order to obtain the strength of the base metal. However, when a large amount exceeding 0.30% is added, weldability is degraded and the toughness of the welded joint is degraded. Therefore, it is necessary to set the Si content to be 0.01% to 0.30%. Preferably, the Si content is 0.20% or less.

Mn: 0.5% to 1.95%

In order to secure the strength of the base metal and the strength of the welded joint, Mn is added in an amount of 0.5% or more. However, when the amount of Mn added exceeds 1.95%, weldability is degraded, hardenability becomes excessive, and the toughness of the base metal and the toughness of the welded joint are degraded. Therefore, the Mn content is set in the range of 0.5% to 1.95%.

P: 0.008% or less

P, which is an impurity element, degrades the toughness of the base metal and the toughness of the weld zone. In particular, when the P content in the weld zone exceeds 0.008%, toughness is markedly degraded. Therefore, the P content is set at 0.008% or less.

S: 0.005% or less

S is an impurity that is inevitably contained. When the S content exceeds 0.005%, the toughness of the base metal and the toughness of the weld zone are degraded. Therefore, the S content is set at 0.005% or less, and preferably 0.0035% or less.

Al: 0.015% to 0.06%

Al is an element to be added in order to deoxidize molten steel, and it is necessary to set the Al content at 0.015% or more. On the other hand, when the amount of Al added exceeds 0.06%, the toughness of the base metal and the toughness of the weld zone are degraded, and Al is mixed into the weld metal by dilution due to welding, which degrades toughness. Therefore, the Al content is limited to 0.06% or less, and preferably 0.05% or less. Note that, in the present invention, the Al content is specified in terms of acid-soluble Al (also referred to as "Sol. Al" or the like).

Nb: 0.011% to 0.05%

Nb forms an unrecrystallized zone in the low temperature region of austenite. Therefore, by performing rolling in such a temperature region, the structure of the base metal can be refined and the toughness of the base metal can be increased. Furthermore, precipitation strengthening can be achieved by air cooling after rolling/cooling or by the subsequent temper treatment. In order to obtain the effects described above, it is necessary to set the Nb content at 0.011% or more. However, when the Nb content exceeds 0.05%, toughness is degraded. Therefore, the upper limit is set to be 0.05%, and preferably 0.04%.

Ti: 0.005% to 0.02%

Ti is precipitated as TiN when molten steel solidifies, which suppresses coarsening of austenite in the weld zone, thus contributing to improvement of the toughness of the weld zone. However, when the Ti content is less than 0.005%, such an effect is small. On the other hand, when the Ti content exceeds 0.02%, TiN coarsens, and it is not possible to obtain the effect of improving the toughness of the base metal and the toughness of the weld zone. Therefore, the Ti content is set to be 0.005% to 0.02%.

N: 0.001% to 0.006%

N reacts with Al to form precipitates. Thereby, crystal grains are refined, and the toughness of the base metal is improved. Furthermore, N is an essential element for forming TiN which suppresses coarsening of the structure of the weld zone. In order to obtain such effects, it is necessary to set the N content at 0.001% or more. On the other hand, when the N content exceeds 0.006%, solute N markedly degrades the toughness of the base metal and the toughness of the weld zone. Therefore, the upper limit is set at 0.006%.

Ca: 0.0005% to 0.003%

Ca is an element that improves toughness by fixing S. In order to obtain this effect, it is necessary to add Ca in an amount of at least 0.0005%. However, even when the Ca content exceeds 0.003%, the effect is saturated. Therefore, the Ca content is set in the range of 0.0005% to 0.003%.

Ceq: 0.44 or less

When Ceq specified by formula (1) exceeds 0.44, weldability and the toughness of the weld zone are degraded. Therefore, Ceq is set at 0.44 or less, and preferably 0.42 or less.

$$Ceq=[C]+[Mn]/6+([Cu]+[Ni])/15+([Cr]+[Mo]+[V])/5 \quad (1)$$

where [M] is the content of element M (percent by mass). When the element M is not contained, [M] is 0.

Ti/N: 1.5 to 3.5

When Ti/N is less than 1.5, the amount of TiN formed decreases, and solute N not forming TiN degrades the toughness of the weld zone. Furthermore, when Ti/N exceeds 3.5, TiN is coarsened to degrade the toughness of the weld zone. Therefore, Ti/N is set in the range of 1.5 to 3.5, and preferably 1.8 to 3.2. In Ti/N, each element represents the content (percent by mass).

$$0<\{[Ca]-(0.18+130\times[Ca])\times[O]\}/1.25/[S]<1 \quad (2)$$

$\{[Ca]-(0.18+130\times[Ca])\times[O]\}/1.25/[S]$ is a value representing the atomic concentration ratio of Ca and S which are effective for sulfide morphology control, is also referred to as the "ACR value". The sulfide morphology can be estimated by this value, and this is specified in order to finely disperse CaS which is not dissolved even at high temperatures and which acts as nuclei for the ferrite transformation. In the formula, [Ca], [S], and [O] represent contents of the individual elements (percent by mass).

When the ACR value is 0 or less, CaS is not crystallized. Consequently, S is precipitated in the form of MnS only, and thus, it is not possible to obtain ferrite transformation product nuclei in the weld heat-affected zone. Furthermore, the MnS precipitated alone is elongated during rolling and causes degradation in the toughness of the base metal.

On the other hand, when the ACR value is 1 or more, S is completely fixed by Ca, and MnS acting as nuclei for the ferrite transformation is not precipitated on CaS. Consequently, complex sulfides cannot achieve fine dispersion of nuclei for the ferrite transformation, and thus it is not possible to obtain a toughness-improving effect.

When the ACR value is more than 0 and less than 1, MnS is precipitated on CaS to form complex sulfides, which can effectively act as nuclei for the ferrite transformation. The ACR value is preferably in the range of 0.2 to 0.8.

$$5.5[C]^{4/3}+15[P]+0.90[Mn]+0.12[Ni]+7.9[Nb]^{1/2}+0.53[Mo]\leq 3.10 \quad (3)$$

where [M] is the content of element M (percent by mass)

The value of the left-hand side of formula (3) is the hardness index of the center segregation area including components that are likely to be concentrated in center segregation, and will be referred to as the "Ceq* value" in the description below. Since the CTOD test is carried out over the entire thickness of a steel plate, specimens include center segregation. In the case where the composition concentration in the center segregation is noticeable, a hardened region occurs in the weld heat-affected zone. Therefore, a satisfactory value cannot be obtained. By controlling the Ceq* value to an appropriate range, an excessive increase in hardness in the center segregation area can be suppressed, and an excellent CTOD property can be obtained even in the weld zone of a thick steel plate. The appropriate range of the Ceq* value has been experimentally obtained. When the Ceq* value exceeds 3.10, the CTOD property is degraded. Therefore, the Ceq* value is set at 3.10 or less, and preferably 2.90 or less. In order to obtain a satisfactory CTOD property, it is not necessary to specify the lower limit of the Ceq* value. However, alloy elements must be added in amounts required for obtaining the target strength. Therefore, in the present invention, the Ceq* value is preferably 2.0 or more.

The essential chemical composition of an embodiment of the present invention has been described above. In the case where further improvement in properties is desired, one or two or more selected from 0.20% to 2% of Cr, 0.1% to 0.7% of Mo, 0.005% to 0.1% of V, 0.49% or less of Cu, and 2% or less of Ni can be incorporated.

Cr: 0.20% to 2%

Cr is an element that is effective in increasing the strength of the base metal. In order to obtain this effect, the Cr content is preferably 0.20% or more. However, an excessively high Cr content adversely affects toughness. Therefore, the Cr content is preferably 0.20% to 2%, and more preferably 0.20% to 1.5%, when contained.

Mo: 0.1% to 0.7%

Mo is an element that is effective in increasing the strength of the base metal. In order to obtain this effect, the Mo content is preferably 0.1% or more. However, an excessively high Mo content adversely affects toughness. Therefore, the Mo content is preferably 0.1% to 0.7%, and more preferably 0.1% to 0.6%, when contained.

V: 0.005% to 0.1%

V is an element that is effective in improving the strength and toughness of the base metal at a V content of 0.005% or more. However, when the V content exceeds 0.1%, toughness is degraded. Therefore, the V content is preferably 0.005% to 0.1%, when contained.

Cu: 0.49% or less

Cu is an element that has an effect of improving the strength of steel. In order to obtain the effect, the Cu content is preferably 0.1% or more. However, a Cu content of more than 0.49% causes hot brittleness and degrades the surface properties of the steel plate. Therefore, the Cu content is preferably 0.49% or less, when contained.

Ni: 2% or less

Ni is an element that is effective in improving the strength and toughness of steel, and also effective in improving the toughness of the weld zone. In order to obtain such effects, the Ni content is preferably 0.1% or more. However, Ni is an expensive element, and excessive addition degrades hot ductility and is likely to cause flaws on the surface of the slab during casting. Therefore, the upper limit of the Ni content is preferably 2%, when contained.

2. Hardness Distribution $$H_{Vmax}/H_{Vave}\leq 1.35+0.006/[C]-t/500 \quad (4)$$

$H_{Vmax}$ is the maximum value of Vickers hardness of the center segregation area, $H_{Vave}$ is the average value of Vickers hardness of a portion of the steel plate excluding a region extending from the front surface to ¼ of the plate thickness, a region extending from the back surface to ¼ of the plate thickness, and the center segregation area, [C] is the C content (percent by mass), and t is the thickness (mm) of the steel plate. $H_{Vmax}/H_{Vave}$ is the nondimensional parameter representing the hardness of the center segregation area, and when the value is greater than a value determined by 1.35+0.006/[C]−t/500, the CTOD value decreases. Therefore, $H_{Vmax}/H_{Vave}$ is set to be equal to or less than 1.35+0.006/[C]−t/500, and preferably equal to or less than 1.25+0.006/[C]−t/500.

$H_{Vmax}$ is the hardness of the center segregation area, and is defined as the maximum value among the measured values in the range of 40 mm in the thickness direction, including the center segregation area, measured with a Vickers hardness tester (load 10 kgf) at an interval of 0.25 mm in the thickness direction. Furthermore, $H_{Vave}$ is the average value of hardness and is defined as the average of measured values when a region between ¼ of the thickness from the front surface and ¼ of the thickness from the back surface excluding the center segregation area is measured with a Vickers hardness tester with a load of 10 kgf at a certain interval (e.g., 1 to 2 mm) in the thickness direction.

3.

$$Rs(=12.5(X[Si]+X[Mn]+X[Cu]+X[Ni])+1.5X[P]+1.8X[Nb])<64.3 \quad (5)$$

where X[M] represents (concentration of M in center segregation area)/(average concentration of M), and M represents the type of alloy element added.

Rs is the formula expressing the degree of center segregation of the steel plate, which the present inventors propose. A larger Rs value indicates a higher degree of center segregation of the steel plate. When the Rs value is 64.3 or more, the CTOD property is markedly degraded. Therefore, the Rs value is set at less than 64.3, and preferably 62.3 or less. A smaller Rs value indicates that the adverse effect of segregation decreases. As the Rs value decreases, the CTOD property tends to be more satisfactory. Therefore, the lower limit of the Rs value is not particularly set.

X[M] representing (concentration of M in center segregation area)/(average concentration of M) is determined by the method described below. In a region of 500 μm×500 μm including center segregation at a representative position, area analysis by electron probe X-ray microanalysis (EPMA) for Mn is performed with a beam diameter of 2 μm, at a pitch of 2 μm, and for 0.07 seconds per point, on three fields of view. On five points with a high concentration of Mn among them, line analysis by electron probe X-ray microanalysis (EPMA) in the thickness direction for Si, Mn, P, Cu, Ni, and Nb is performed with a beam diameter of 5 μm, at a pitch of 5 μm, and for 10 seconds per point. The average of the maximums of the individual measurement lines is defined as the concentration in the segregation area, which is divided by the analysis value for each component. Thus, X[M] representing (concentration of M in center segregation area)/(average concentration of M) is determined.

Furthermore, it is known that the CTOD property is influenced, in addition to by the degree of embrittlement (hardening due to center segregation) at the entire base of the notch, also by the degree of embrittlement in extremely small regions at the base of the notch. The CTOD value is decreased by the very small brittle region at the base of the notch. Therefore, in the case where a strict evaluation (testing at low temperatures or the like) is performed, the existence of extremely small brittle regions has a major effect. In the high tensile strength steel plate having excellent weld heat-affected zone low-temperature toughness according to aspects of the present invention, the degree of segregation in the center segregation is specified by formula (3), and furthermore, the distributions of hardness and alloy elements in extremely small regions in the center segregation are specified by formulas (4) and (5).

The steel of the present invention is preferably produced by the production method described below. A molten steel having a chemical composition adjusted to be within the preferred ranges of the present invention is refined by a commonly used process using a converter, an electric furnace, a vacuum melting furnace, or the like, and then is formed into a slab by a continuous casting process. The slab is subjected to hot rolling to obtain a desired thickness, followed by cooling and temper treatment. In the hot rolling, the slab heating temperature and the rolling reduction are specified.

In the present invention, unless otherwise particularly noted, temperature conditions of the steel plate are specified at the temperature at the center of thickness of the steel plate. The temperature at the center of thickness can be obtained by simulated calculation or the like on the basis of the thickness, the surface temperature, cooling conditions, and the like. For example, the temperature at the center of thickness can be obtained by calculating the temperature distribution in the thickness direction using the calculus of finite differences.

Slab heating temperature: 1,050° C. to 1,200° C.

The slab heating temperature is set at 1,050° C. or higher so that cast defects in the slab can be reliably pressure-bonded by hot rolling. When heating is performed at a temperature exceeding 1,200° C., TiN precipitated during solidification is coarsened, resulting in degradation in toughness in the base metal and the weld zone. Therefore, the upper limit of the heating temperature is set at 1,200° C.

Cumulative rolling reduction in the temperature range of 950° C. or higher: 30% or more In order to recrystallize austenite grains into a fine microstructure, the cumulative rolling reduction is set at 30% or more. When the cumulative rolling reduction is less than 30%, abnormally coarsened grains generated during heating remain and adversely affect the base metal toughness.

Cumulative rolling reduction in the temperature range of lower than 950° C.: 30% to 70%

Since the austenite grains rolled in this temperature range are not sufficiently recrystallized, rolled austenite grains remain in an elongated deformed shape and include a large amount of defects, such as deformation bands, in which internal strain is high. They serve as a drive force for ferrite transformation to promote ferrite transformation.

However, when the cumulative rolling reduction is less than 30%, accumulation of internal energy due to internal strain is not sufficient. Therefore, ferrite transformation is not likely to occur, resulting in a decrease in the base metal toughness. On the other hand, when the cumulative rolling reduction exceeds 70%, formation of polygonal ferrite is promoted, and high strength and high toughness cannot be simultaneously achieved.

Cooling rate to 600° C. or lower: 1.0° C./s or more

After the hot rolling, accelerated cooling is performed to 600° C. or lower at a cooling rate of 1.0° C./s or more. When the cooling rate is less than 1° C./s, it is not possible to obtain sufficient strength of the base metal. Furthermore, when cooling is stopped at a temperature higher than 600° C., the structural fractions of ferrite+pearlite, upper bainite, and the like increase, and high strength and high toughness cannot be simultaneously achieved. Furthermore, in the case where tempering is performed after the accelerated cooling, the lower limit of the accelerated cooling stop temperature is not particularly limited. On the other hand, in the case where tempering is not performed in the subsequent step, the accelerated cooling stop temperature is preferably set at 350° C. or higher.

Tempering temperature: 450° C. to 650° C.

When the tempering temperature is lower than 450° C., it is not possible to obtain a sufficient effect of tempering. On the other hand, when tempering is performed at a temperature higher than 650° C., carbonitrides are coarsely precipitated, toughness is degraded, and strength may also be decreased, which is undesirable. Furthermore, by performing tempering by induction heating, coarsening of carbides during tempering can be suppressed, which is more preferable. In such a case, the temperature at the center of the steel plate calculated by simulation, such as the calculus of finite differences, is set to be 450° C. to 650° C.

In the steel of the present invention, coarsening of austenite grains in the weld heat-affected zone is preferably suppressed, and furthermore, nuclei for the ferrite transformation, which are not dissolved even at high temperatures, are preferably finely dispersed. Thereby, the structure of the weld heat-affected zone is refined. Thus, high toughness can be obtained. Furthermore, in the region which is reheated into a dual-phase region by a heat cycle during multilayer welding, since the structure of the weld heat-affected zone formed by the first welding is refined, the toughness of the non-transformation area in the dual phase re-heating region is improved, retransformed austenite grains are also refined, and the degree of degradation of toughness can be decreased.

EXAMPLES

Continuously cast slabs of steel codes A to W having chemical compositions shown in Table 1 were prepared, and then hot rolling and heat treatment were performed. Thereby, steel plates with a thickness of 50 to 100 mm were produced. Regarding the methods for evaluating the base metal, in the tensile test, a JIS No. 4 specimen was taken at ½ of the thickness of each steel plate such that the longitudinal direction of the specimen was perpendicular to the rolling direction of the steel plate, and yield stress (YS) and tensile strength (TS) were measured.

Furthermore, in the Charpy impact test, a JIS V notch specimen was taken at ½ of the thickness of each steel plate such that the longitudinal direction of the specimen was perpendicular to the rolling direction of the steel plate, and absorbed energy $vE_{-40^\circ C.}$ at −40° C. was measured. Steel plates that satisfy all of YS≥400 MPa, TS≥500 MPa, and $vE_{-40^\circ C.}$≥200 J were evaluated as having good base metal properties.

Regarding the evaluation of the weld zone toughness, using a double bevel groove, a multilayer welded joint was formed by submerged arc welding at a weld heat input of 45 to 50 kJ/cm, and by setting a notch position for the Charpy impact test on the straight side of the weld bond at ¼ of the thickness of the steel plate, absorbed energy $vE_{-40^\circ C.}$ at −40° C. was measured. Steel plates in which the average of three measurements satisfies $vE_{-40^\circ C.}$≥200 J were evaluated as having good welded joint toughness.

Furthermore, by setting a notch position of the three-point bending CTOD test specimen at the weld bond on the straight side, $\delta_{-10^\circ C.}$, i.e., the CTOD value at −10° C., was measured. Steel plates in which the minimum of the CTOD value ($\delta_{-10^\circ C.}$) among three measured values was 0.35 mm or more were evaluated as having a good CTOD property in the welded joint.

Tables 2-1 and 2-2 show hot rolling conditions, heat treatment conditions, base metal properties, and the results of the Charpy impact test and the CTOD test in the weld zone.

Steels A to G are examples of the invention, and steels H to W are comparative examples in which any one of the chemical components is out of the preferred range of the present invention. In Examples 1 to 5, 8, 11 to 13, 15, and 16, Rs<64.3 is satisfied, and the CTOD property in the joint that meets the target is obtained.

In Examples 6 and 7, the production conditions are out of the preferred ranges of the present invention, and the target base metal toughness is not obtained. In Examples 9 and 10, since the tempering condition is out of the preferred range of the present invention, strength is low, and toughness is also low. In Example 14, since the cooling rate after the rolling is lower than the preferred range of the present invention, the strength of the base metal is low. In Examples 19, 22, and 25, since the contents of C, Mn, and Nb, respectively, are lower than the preferred ranges of the present invention, the strength of the base metal is low.

In Examples 20 and 21, since formula (2): $0<\{[Ca]-(0.18+130\times[Ca])\times[O]\}/1.25/[S]<1$ is not satisfied, the weld zone toughness is low. In Example 23, since the S content exceeds the preferred range of the present invention, the base metal toughness and the weld zone toughness are low. In Example 24, since the C content exceeds the preferred range of the present invention, the weld zone toughness is low. Examples 17, 18, and 26 to 32 are out of the preferred range of the chemical composition of the present invention, and the weld zone toughness is low.

TABLE 1

| Steel | C | Si | Mn | P | S | Cu | Ni | Cr | Mo | Nb | V | Ti | Al | N | Ca | O | Ceq | Ceq* | ACR | Ti/N | Remarks |
|---|---|---|---|---|---|---|---|---|---|---|---|---|---|---|---|---|---|---|---|---|---|
| | (% by mass) | | | | | | | | | | | | | | | | | | | | |
| A | 0.071 | 0.13 | 1.65 | 0.007 | 0.0015 | 0.20 | 0.30 | — | — | 0.012 | — | 0.008 | 0.023 | 0.0045 | 0.0018 | 0.0023 | 0.379 | 2.65 | 0.452 | 1.8 | Example of invention |
| B | 0.103 | 0.07 | 1.25 | 0.005 | 0.0012 | — | — | — | — | 0.026 | 0.03 | 0.011 | 0.042 | 0.0034 | 0.0023 | 0.0030 | 0.318 | 2.74 | 0.575 | 3.2 | Example of invention |
| C | 0.110 | 0.12 | 0.85 | 0.006 | 0.0015 | 0.35 | 0.35 | 0.22 | — | 0.025 | 0.04 | 0.013 | 0.035 | 0.0045 | 0.0022 | 0.0025 | 0.337 | 2.44 | 0.552 | 2.9 | Example of invention |
| D | 0.082 | 0.15 | 1.55 | 0.004 | 0.0019 | — | — | — | — | 0.024 | — | 0.012 | 0.033 | 0.0044 | 0.0018 | 0.0035 | 0.340 | 2.87 | 0.148 | 2.7 | Example of invention |
| E | 0.049 | 0.18 | 1.52 | 0.008 | 0.0018 | 0.22 | 0.65 | 0.25 | — | 0.023 | — | 0.017 | 0.035 | 0.0055 | 0.0022 | 0.0029 | 0.410 | 2.86 | 0.377 | 3.1 | Example of invention |
| F | 0.085 | 0.12 | 1.42 | 0.005 | 0.0016 | — | 0.54 | 0.30 | — | 0.024 | — | 0.012 | 0.032 | 0.0044 | 0.0020 | 0.0024 | 0.388 | 2.85 | 0.472 | 2.7 | Example of invention |
| G | 0.078 | 0.20 | 1.58 | 0.006 | 0.0020 | 0.15 | 0.40 | — | 0.15 | 0.018 | — | 0.011 | 0.030 | 0.0040 | 0.0026 | 0.0030 | 0.408 | 2.88 | 0.418 | 2.8 | Example of invention |
| H | 0.093 | 0.26 | 1.64 | 0.008 | 0.0022 | — | 0.15 | — | 0.10 | 0.028 | — | 0.009 | 0.033 | 0.0043 | 0.0020 | 0.0020 | 0.396 | 3.22 | 0.407 | 2.1 | Comparative Example |
| I | 0.112 | 0.25 | 1.44 | 0.012 | 0.0020 | — | — | — | — | 0.025 | — | 0.010 | 0.032 | 0.0039 | 0.0016 | 0.0032 | 0.352 | 3.02 | 0.143 | 2.6 | Comparative Example |
| J | 0.023 | 0.23 | 1.76 | 0.008 | 0.0018 | 0.40 | 0.30 | 0.20 | — | 0.011 | — | 0.013 | 0.035 | 0.0045 | 0.0020 | 0.0022 | 0.403 | 2.60 | 0.459 | 2.9 | Comparative Example |
| K | 0.053 | 0.20 | 1.66 | 0.006 | 0.0012 | 0.35 | 0.40 | — | — | 0.015 | 0.02 | 0.011 | 0.033 | 0.0039 | 0.0028 | 0.0011 | 0.384 | 2.71 | 1.468 | 2.8 | Comparative Example |
| L | 0.082 | 0.20 | 1.42 | 0.006 | 0.0029 | 0.20 | 0.04 | — | — | 0.015 | — | 0.011 | 0.032 | 0.0040 | 0.0011 | 0.0038 | 0.335 | 2.54 | −0.035 | 2.8 | Comparative Example |
| M | 0.110 | 0.13 | 0.44 | 0.005 | 0.0023 | 0.30 | 0.55 | 0.32 | 0.15 | 0.025 | 0.04 | 0.011 | 0.025 | 0.0041 | 0.0025 | 0.0022 | 0.342 | 2.16 | 0.483 | 2.7 | Comparative Example |
| N | 0.110 | 0.25 | 1.75 | 0.006 | 0.0063 | — | — | — | — | 0.020 | — | 0.010 | 0.026 | 0.0038 | 0.0027 | 0.0022 | 0.402 | 3.07 | 0.195 | 2.6 | Comparative Example |
| O | 0.134 | 0.26 | 1.70 | 0.005 | 0.0022 | — | — | 0.28 | — | 0.015 | 0.05 | 0.013 | 0.029 | 0.0045 | 0.0019 | 0.0018 | 0.482 | 2.95 | 0.411 | 2.9 | Comparative Example |
| P | 0.072 | 0.15 | 1.43 | 0.006 | 0.0018 | 0.33 | 0.50 | 0.20 | — | 0.008 | — | 0.011 | 0.025 | 0.0035 | 0.0020 | 0.0030 | 0.406 | 2.31 | 0.302 | 3.1 | Comparative Example |
| Q | 0.070 | 0.20 | 1.61 | 0.007 | 0.0015 | 0.20 | 0.80 | 0.18 | 0.10 | 0.033 | — | 0.012 | 0.026 | 0.0028 | 0.0023 | 0.0022 | 0.461 | 3.30 | 0.665 | 4.3 | Comparative Example |
| R | 0.065 | 0.16 | 1.62 | 0.007 | 0.0018 | 0.32 | 0.35 | 0.25 | — | 0.025 | — | 0.015 | 0.025 | 0.0041 | 0.0020 | 0.0018 | 0.430 | 3.00 | 0.537 | 3.7 | Comparative Example |
| S | 0.074 | 0.28 | 1.65 | 0.007 | 0.0022 | — | — | — | — | 0.025 | — | 0.008 | 0.026 | 0.0060 | 0.0020 | 0.0020 | 0.349 | 3.01 | 0.407 | 1.3 | Comparative Example |
| T | 0.040 | 0.22 | 2.15 | 0.006 | 0.0020 | — | 0.20 | — | — | 0.012 | | 0.011 | 0.033 | 0.0037 | 0.0022 | 0.0022 | 0.412 | 2.99 | 0.470 | 3.0 | Comparative Example |
| U | 0.105 | 0.42 | 1.55 | 0.006 | 0.0022 | — | — | 0.21 | 0.20 | 0.022 | — | 0.016 | 0.030 | 0.0054 | 0.0015 | 0.0011 | 0.445 | 3.04 | 0.395 | 3.0 | Comparative Example |
| V | 0.110 | 0.25 | 1.42 | 0.008 | 0.0020 | 0.25 | — | 0.26 | — | 0.025 | 0.04 | 0.026 | 0.032 | 0.0058 | 0.0020 | 0.0023 | 0.424 | 2.94 | 0.395 | 4.5 | Comparative Example |
| W | 0.116 | 0.25 | 1.41 | 0.008 | 0.0018 | 0.25 | — | 0.26 | — | 0.025 | 0.04 | 0.019 | 0.026 | 0.0071 | 0.0022 | 0.0025 | 0.428 | 2.95 | 0.460 | 2.7 | Comparative Example |

Note 1:
Underlined portions are out of the ranges of the present invention.
Note 2:
ACR = ([Ca] − (0.18 + 130*[Ca])*[O])/1.25*[S], M is the content of element M (% by mass).
Note 3:
Ceq = [C] + [Mn]/6 + [Cu]/15 + [Ni]/15 + [Cr]/5 + [Mo]/5 + [V]/5, M is the content of element M (% by mass).
Note 4:
$Ceq^* = 5.5[C]^{4/3} + 15[P] + 0.90[Mn] + 0.12[Ni] + 7.9[Nb]^{1/2} + 0.53[Mo]$, [M] is the content of element M (% by mass).

TABLE 2-1

| No | Steel code | Slab thickness (mm) | Rolling conditions: Heating temperature (° C.) | Cumulative rolling reduction at 950° C. or higher (%) | Cumulative rolling reduction at lower than 950° C. (%) | Finish rolling temperature (° C.) | Steel plate thickness (mm) | Cooling conditions: Cooling rate (° C./s) | Cooling stop temperature (° C.) | Tempering conditions: Tempering temperature (° C.) | Tempering method | Base material properties: YP (MPa) | TS (MPa) | $vE_{-40° C.}$ (J) | 1.52 + 0.006/[C] − t/500 | HV max/ave | Rs(12.5(X[Si] + X[Mn] + X[Cu] + X[Ni]) + 1.5X[P] + 1.8X[Nb]) | Welded zone toughness: $vE_{-40° C.}$ (J) | CTOD $\delta_{-10° C.}$ (mm) | Remarks |
|---|---|---|---|---|---|---|---|---|---|---|---|---|---|---|---|---|---|---|---|---|
| 1 | A | 250 | 1080 | 40 | 67 | 750 | 50 | 11.5 | 575 | — | — | 522 | 615 | 298 | 1.33 | 1.21 | 523 | 256 | 1.15 | Example of invention |
| 2 | A | 250 | 1085 | 40 | 67 | 750 | 50 | 11.5 | 450 | 610 | Atmosphere furnace | 526 | 609 | 277 | 1.33 | 1.24 | 15.9 | 241 | 1.21 | Example of invention |
| 3 | A | 250 | 1083 | 40 | 67 | 750 | 50 | 11.5 | 200 | 635 | Induction heating | 536 | 616 | 311 | 1.33 | 1.22 | 553 | 248 | 1.18 | Example of invention |
| 4 | A | 250 | 1079 | 40 | 53 | 730 | 70 | 5.0 | 450 | — | — | 462 | 560 | 293 | 1.29 | 1.18 | 54.6 | 249 | 0.97 | Example of invention |
| 5 | A | 310 | 1097 | 38 | 48 | 710 | 100 | 2.0 | 470 | — | — | 451 | 548 | 272 | 1.23 | 1.17 | 61.9 | 264 | 0.85 | Example of invention |
| 6 | A | 200 | 1080 | 24 | 67 | 750 | 50 | 11.5 | 515 | — | — | 469 | 542 | 77 | 1.33 | 1.28 | 56.2 | — | — | Comparative Example |
| 7 | A | 310 | 1075 | 60 | 20 | 710 | 100 | 2.0 | 480 | — | — | 452 | 553 | 85 | 1.23 | 1.12 | 52.0 | — | — | Comparative Example |
| 8 | B | 250 | 1102 | 40 | 67 | 750 | 50 | 11.5 | 520 | — | — | 442 | 525 | 288 | 1.31 | 1.18 | 49.8 | 224 | 1.25 | Example of invention |
| 9 | B | 250 | 1098 | 40 | 67 | 748 | 50 | 11.5 | 520 | 670 | Atmosphere furnace | 422 | 496 | 165 | 1.31 | — | — | — | — | Comparative Example |
| 10 | B | 250 | 1098 | 40 | 67 | 748 | 50 | 11.5 | 230 | 420 | Induction heating | 409 | 576 | 96 | 1.31 | — | — | — | — | Comparative Example |
| 11 | C | 250 | 1180 | 35 | 69 | 730 | 50 | 11.5 | 520 | — | — | 472 | 560 | 279 | 1.30 | 1.17 | 7.5 | 244 | 1.22 | Example of invention |
| 12 | D | 250 | 1148 | 48 | 62 | 760 | 50 | 11.5 | 520 | — | — | 485 | 579 | 226 | 1.32 | 1.09 | 51.0 | 215 | 1.13 | Example of invention |
| 13 | E | 350 | 1054 | 38 | 54 | 710 | 100 | 2.0 | 450 | — | — | 454 | 550 | 285 | 1.27 | 1.08 | 53.1 | 267 | 0.87 | Example of invention |
| 14 | E | 595 | 1054 | 38 | 54 | 710 | 170 | 0.8 | 430 | — | — | 411 | 506 | 106 | 1.13 | — | — | — | — | Comparative Example |
| 15 | F | 350 | 1088 | 38 | 54 | 710 | 100 | 2.2 | 460 | — | — | 452 | 555 | 274 | 1.22 | 1.11 | 45.3 | 254 | 0.96 | Example of invention |
| 16 | G | 350 | 1080 | 38 | 54 | 710 | 100 | 2.0 | 425 | 470 | Atmosphere furnace | 436 | 558 | 219 | 1.23 | 1.20 | 39 6 | 239 | 1.10 | Example of invention |

Note 1:
Underlined portions are out of the ranges of the present invention.

TABLE 2-2

| | | | Rolling conditions | | | | | Cooling conditions | | Tempering conditions | | Base material properties | | | | | | Welded zone toughness | | |
|---|---|---|---|---|---|---|---|---|---|---|---|---|---|---|---|---|---|---|---|---|
| No | Steel code | Slab thickness (mm) | Heating temperature (° C.) | Cumulative rolling reduction at 950° C. or higher (%) | Cumulative rolling reduction at lower than 950° C. (%) | Finish rolling temperature (° C.) | Steel plate thickness (mm) | Cooling rate (° C./s) | Cooling stop temperature (° C.) | Tempering temperature (° C.) | Tempering method | YP (MPa) | TS (MPa) | $vE_{-40° C.}$ (J) | 1.52 + 0.006/[C] − t/500 | HV max/HV ave | Rs(12.5(X[Si] + X[Mn] + X[Cu] + X[Ni]) + 1.5X[P] + 1.8X[Nb]) | $vE_{-40° C.}$ (J) | CTOD $\delta_{-10° C.}$ (mm) | Remarks |
| 17 | H | 250 | 1120 | 40 | 67 | 748 | 50 | 11.5 | 515 | — | — | 466 | 548 | 210 | 1.31 | 1.35 | 67.2 | 65 | 0.07 | Comparative Example |
| 18 | I | 250 | 1120 | 40 | 67 | 748 | 50 | 11.5 | 515 | — | — | 478 | 567 | 227 | 1.30 | 1.33 | 68.0 | 59 | 0.13 | Comparative Example |
| 19 | J | 250 | 1120 | 40 | 67 | 745 | 50 | 11.5 | 530 | — | — | 385 | 498 | 250 | 1.51 | — | — | — | — | Comparative Example |
| 20 | K | 250 | 1120 | 40 | 67 | 740 | 50 | 11.5 | 520 | 610 | Atmosphere furnace | 455 | 537 | 232 | 1.36 | 1.21 | 68.8 | 115 | 0.26 | Comparative Example |
| 21 | L | 250 | 1120 | 40 | 67 | 720 | 50 | 11.5 | 520 | — | — | 436 | 544 | 279 | 1.32 | 1.15 | | 93 | 0.10 | Comparative Example |
| 22 | M | 250 | 1120 | 40 | 67 | 735 | 50 | 11.5 | 525 | — | — | 399 | 487 | 274 | 1.30 | — | — | — | — | Comparative Example |
| 23 | N | 350 | 1120 | 38 | 54 | 722 | 100 | 2.0 | 470 | — | — | 445 | 552 | 88 | 1.20 | 1.17 | 60.6 | 46 | 0.08 | Comparative Example |
| 24 | O | 350 | 1120 | 38 | 54 | 710 | 100 | 2.0 | 460 | — | — | 468 | 579 | 234 | 1.19 | 1.23 | 58.8 | 52 | 0.06 | Comparative Example |
| 25 | P | 350 | 1120 | 38 | 54 | 710 | 100 | 2.0 | 470 | — | — | 389 | 498 | 288 | 1.23 | — | — | — | — | Comparative Example |
| 26 | Q | 350 | 1120 | 38 | 54 | 735 | 100 | 2.0 | 470 | — | — | 448 | 566 | 202 | 1.24 | 1.26 | 70.6 | 204 | 0.12 | Comparative Example |
| 27 | R | 350 | 1120 | 38 | 54 | 722 | 100 | 2.0 | 450 | — | — | 458 | 574 | 221 | 1.24 | 1.19 | 40.6 | 87 | 0.16 | Comparative Example |
| 28 | S | 350 | 1120 | 38 | 54 | 710 | 100 | 2.0 | 470 | — | — | 442 | 547 | 264 | 1.23 | 1.18 | 43.6 | 210 | 0.09 | Comparative Example |
| 29 | T | 350 | 1120 | 38 | 54 | 715 | 100 | 2.0 | 475 | — | — | 479 | 588 | 220 | 1.30 | 1.31 | 58.7 | 203 | 0.28 | Comparative Example |
| 30 | U | 350 | 1120 | 38 | 54 | 720 | 100 | 2.0 | 470 | — | — | 450 | 570 | 270 | 1.21 | 1.11 | 61.0 | 71 | 0.22 | Comparative Example |
| 31 | V | 350 | 1120 | 38 | 54 | 710 | 100 | 2.0 | 470 | — | — | 455 | 571 | 84 | 1.20 | 1.14 | 58.4 | 36 | 0.08 | Comparative Example |
| 32 | W | 350 | 1120 | 38 | 54 | 710 | 100 | 2.0 | 470 | — | — | 449 | 566 | 53 | 1.20 | 1.15 | 59.6 | 45 | 0.07 | Comparative Example |

Note 1:
Underlined portions are out of the ranges of the present invention.

The invention claimed is:

1. A high tensile strength steel plate having a chemical composition comprising, in percent by mass, 0.03% to 0.12% of C, 0.01% to 0.30% of Si, 0.5% to 1.58% of Mn, 0.008% or less of P, 0.005% or less of S, 0.015% to 0.06% of Al, 0.011% to 0.05% of Nb, 0.005% to 0.02% of Ti, 0.001% to 0.0044% of N, 0.0005% to 0.003% of Ca, in which Ceq specified by formula (1) below is 0.44 or less, TI/N is 1.5 to 3.5, and formulas (2) and (3) below are satisfied, and the balance being Fe and incidental impurities, wherein the hardness of a center segregation area of the steel plate satisfies formula (4) below:

$$Ceq=[C]+[Mn]/6+([Cu]+[Ni])/15+([Cr]+[Mo]+[V])/5 \quad (1)$$

$$0<\{[Ca]-(0.18+130\times[Ca])x[O]\}/1.25/[S]<1 \quad (2)$$

$$5.5[C]^{4/3}+15[P]+0.90[Mn]+0.12[Ni]+7.9[Nb]^{1/2}+0.53[Mo]\leq 2.90 \quad (3)$$

where [M] is the content of element M (percent by mass)

$$H_{Vmax}/H_{Vave}\leq 1.35+0.006/[C]-t/500 \quad (4)$$

where $H_{Vmax}$ is the maximum value of Vickers hardness of the center segregation area, $H_{Vave}$ is the average value of Vickers hardness of a portion of the steel plate excluding a region extending from the front surface to ¼ of the plate thickness, a region extending from the back surface to ¼ of the plate thickness, and the center segregation area, [C] is the C content (percent by mass), and t is the thickness (mm) of the steel plate.

2. The high tensile strength steel plate, wherein the steel composition according to claim 1, further comprises, in percent by mass, one or two or more selected from 0.20% to 2% of Cr, 0.1% to 0.7% of Mo, 0.005% to 0.1% of V, 0.49% or less of Cu, and 2% or less of Ni.

3. A method for producing a high tensile strength steel plate comprising heating a steel having the chemical composition according to claim 1 to 1,050° C. to 1,200° C., then subjecting the steel to hot rolling in such a manner that the cumulative rolling reduction in the temperature range of 950° C. or higher is 30% or more, and the cumulative rolling reduction in the temperature range of lower than 950° C. is 30% to 70%, and then performing accelerated cooling to 600° C. or lower at a cooling rate of 1.0° C./s or more.

4. The method for producing a high tensile strength steel plate according to claim 3, further comprising, after cooling is stopped, performing temper treatment at 450° C. to 650° C.

5. The high tensile strength steel plate according to claim 1, wherein the concentrations of the individual elements in the center segregation area satisfy formula (5) below:

$$Rs=12.5(X[Si]+X[Mn]+X[Cu]+X[Ni])+1.5X[P]+1.8X[Nb]<64.3 \quad (5)$$

where X[M] represents the ratio of the concentration of element M in the center segregation area to the average concentration of element M, i.e., (concentration of M in center segregation area)/(average concentration of M), obtained by EPMA line analysis.

6. A method for producing a high tensile strength steel plate comprising heating a steel having the chemical composition according to claim 5 to 1,050° C. to 1,200° C., then subjecting the steel to hot rolling in such a manner that the cumulative rolling reduction in the temperature range of 950° C. or higher is 30% or more, and the cumulative rolling reduction in the temperature range of lower than 950° C. is 30% to 70%, and then performing accelerated cooling to 600° C. or lower at a cooling rate of 1.0° C./s or more.

7. The method for producing a high tensile strength steel plate according to claim 6, further comprising, after cooling is stopped, performing temper treatment at 450° C. to 650° C.

8. A method for producing a high tensile strength steel plate comprising heating a steel having the chemical composition according to claim 2 to 1,050° C. to 1,200° C., then subjecting the steel to hot rolling in such a manner that the cumulative rolling reduction in the temperature range of 950° C. or higher is 30% or more, and the cumulative rolling reduction in the temperature range of lower than 950° C. is 30% to 70%, and then performing accelerated cooling to 600° C. or lower at a cooling rate of 1.0° C./s or more.

9. The high tensile strength steel plate according to claim 2, wherein the concentrations of the individual elements in the center segregation area satisfy formula (5) below:

$$Rs=12.5(X[Si]+X[Mn]+X[Cu]+X[Ni])+1.5X[P]+1.8X[Nb]<64.3 \quad (5)$$

where X[M] represents the ratio of the concentration of element M in the center segregation area to the average concentration of element M, i.e., (concentration of M in center segregation area)/(average concentration of M), obtained by EPMA line analysis.

10. The high tensile strength steel plate according to claim 1, wherein the N amount is 0.001 to 0.0040% by mass.

* * * * *